US012765624B1

(12) United States Patent
Zou

(10) Patent No.: US 12,765,624 B1
(45) Date of Patent: Oct. 20, 2026

(54) HAIR EXTENSION AND MANUFACTURING APPARATUS AND METHOD THEREOF

(71) Applicant: WELLNA CO., LTD, KL (HK)

(72) Inventor: Junna Zou, Rongcheng City (CN)

(73) Assignee: WELLNA CO., LTD, NT (HK)

( * ) Notice: Subject to any disclaimer, the term of this patent is extended or adjusted under 35 U.S.C. 154(b) by 0 days.

(21) Appl. No.: 19/324,119

(22) Filed: Sep. 10, 2025

(30) Foreign Application Priority Data

Aug. 13, 2025 (CN) ..... 202511129504.8

(51) Int. Cl.
*A41G 5/00* (2006.01)

(52) U.S. Cl.
CPC ..... *A41G 5/0046* (2013.01)

(58) Field of Classification Search
CPC ..... A41G 5/0046; A41G 5/0053
See application file for complete search history.

(56) References Cited

U.S. PATENT DOCUMENTS 3,280,826 A * 10/1966 Jenkins ..... A41G 5/004 132/201
6,019,107 A * 2/2000 Overmyer ..... A41G 5/004 132/275
2003/0159705 A1* 8/2003 Ferguson ..... A41G 5/0073 132/201
2011/0005543 A1* 1/2011 Winn ..... A41G 5/0073 132/201
2011/0017228 A1* 1/2011 Freelove ..... A41G 5/0053 132/201
2011/0168196 A1* 7/2011 Freelove ..... A41G 5/0046 132/53
2017/0202290 A1* 7/2017 Thomas ..... A41G 5/006
2021/0227907 A1* 7/2021 Takechi ..... A41G 5/0046
2022/0295928 A1* 9/2022 Smith ..... A41G 5/0046
2022/0408866 A1* 12/2022 Morris ..... A41G 5/0073
2023/0109742 A1* 4/2023 Gray ..... A41G 5/0046 132/201

* cited by examiner

*Primary Examiner* — Nicholas D Lucchesi
(74) *Attorney, Agent, or Firm* — Che-Yang Chen

(57) ABSTRACT

The present invention discloses a hair extension, including a hair extension fixing portion and a hair extension body, wherein the hair extension body is connected to the hair extension fixing portion, the hair extension fixing portion further comprises a connecting hair strand layer, a second hair strand layer, a third hair strand layer, a fourth hair strand layer, two first stitching threads, a second stitching thread, and a third stitching thread, the connecting hair strand layer is connected to the hair extension body, the connecting hair strand layer, the second hair strand layer, the third hair strand layer, and the fourth hair strand layer form a stacked structure, the second hair strand layer is located between the connecting hair strand layer and the third hair strand layer, the third hair strand layer is located between the second hair strand layer and the fourth hair strand layer.

12 Claims, 11 Drawing Sheets

A

B

C

HAIR EXTENSION AND MANUFACTURING APPARATUS AND METHOD THEREOF

TECHNICAL FIELD

This application relates to the field of hair extensions, and in particular, to a hair extension and a hair extension manufacturing method and apparatus.

BACKGROUND

As an important category of hair extensions, hair extensions are mainly used to increase hair volume and create hairstyles. An important feature of the hair extensions is weft edges, used to fix scattered hairs to form the hair extensions. However, the existing hair extensions are mainly manufactured through manual weaving. scattered hairs are manually woven into the hair extensions. The scattered hairs are fixed to the weft edge. However, when the hair weft is put on, the weft edge is fixed to hair of a user and supports weight of the hair weft. Because a width of the weft edge accounts for only a small portion of a width of the hair weft, a fixing structure of the weft edge is particularly important. If the weft edge is inappropriately fixed, hair strands of the hair extension may fall off. This is especially true when the hair pieces are maintained or used for hairstyle design. When the hair wefts are combed, the scattered hairs fixed to the hair pieces are driven by the comb to pull the weft edges, and if the weft edges are inappropriately fixed, hair strands are pulled out by the comb, which shortens service life of the hair wefts.

The manual weaving has such disadvantage that production efficiency depends on experience of workers. For manually woven hair wefts, scattered hairs need to be fixed in advance, and densities of the hair extensions are also determined by the workers based on their experience, resulting in uneven density distribution of the hair wefts, which affects quality of the hair wefts. Therefore, there is a need for a hair weft fixing structure that can fix scattered hairs to the weft edge and that can be manufactured by mechanical means.

SUMMARY OF THE DISCLOSURE

One advantage of this application is that a hair extension is provided, where a fixing structure is provided for the hair extension, so that the hair extension is suitable for mechanical manufacturing.

An advantage of this application is that a hair extension is provided, where a fixing structure is provided for the hair extension, so that the hair extension is suitable for mechanical manufacturing.

Another advantage of this application is that a hair extension manufacturing method is provided, where the hair extension manufacturing method is suitable for mechanical manufacturing.

Still another advantage of this application is that a hair extension manufacturing method is provided, where the scattered hairs are fixed in a stitching method in advance and then further fixed in a folding method.

Yet another advantage of this application is that a hair extension and a manufacturing method thereof are provided, where the hair extension is fixed in stitching and folding methods, which is suitable for mechanical manufacturing.

Still yet another advantage of this application is that a hair extension and a manufacturing apparatus and manufacturing method thereof are provided, where the hair extension manufacturing apparatus further includes a lifting apparatus, and the lifting apparatus lifts a hair extension fixing portion to a preset height.

A further advantage of this application is that a hair extension and a manufacturing apparatus and manufacturing method thereof are provided, where the manufacturing apparatus is further provided with three fixing apparatuses, and one apparatus is used for fixing scattered hairs during stitching.

A still further advantage of this application is that a hair extension and a manufacturing apparatus and manufacturing method thereof are provided, where the manufacturing apparatus further includes at least one folding apparatus, and the folding apparatus folds the hair extension fixing portion of the fixed scattered hairs.

A yet further advantage of this application is that a hair extension manufacturing method and manufacturing apparatus are provided, where the hair extension manufacturing apparatus further includes at least one gluing apparatus, and the gluing apparatus provides glue to the hair extension fixing portion.

To achieve at least one of the foregoing objectives of this application, this application provides a hair extension, including:

a hair extension fixing portion and a hair extension body, where the hair extension body is connected to the hair extension fixing portion, the hair extension fixing portion further includes a connecting hair strand layer, a second hair strand layer, a third hair strand layer, a fourth hair strand layer, two first stitching threads, a second stitching thread, and a third stitching thread, the connecting hair strand layer is connected to the hair extension body, the connecting hair strand layer, the second hair strand layer, the third hair strand layer, and the fourth hair strand layer form a stacked structure, the second hair strand layer is located between the connecting hair strand layer and the third hair strand layer, the third hair strand layer is located between the second hair strand layer and the fourth hair strand layer, the connecting hair strand layer is connected to the hair extension body, the two first stitching threads are respectively used to stitch the connecting hair strand layer and the second hair strand layer, the two first stitching threads are disposed close to the hair extension body, the second stitching thread is used to stitch the third hair strand layer and the fourth hair strand layer, and the third stitching thread is used to stitch the connecting hair strand layer, the second hair strand layer, the third hair strand layer, and the fourth hair strand layer.

In an embodiment of this application, the second stitching thread is located between the hair extension body and the third stitching thread.

In an embodiment of this application, the second stitching thread is disposed on a side closer to the first stitching thread.

In an embodiment of this application, the hair extension fixing portion further includes a first bent portion, the first bent portion is connected to the third hair strand layer and the fourth hair strand layer, and the first bent portion is close to the hair extension body.

In an embodiment of this application, the hair extension fixing portion further includes a second bent portion, the second bent portion is disposed at an end farther away from the hair extension body, the second bent portion further includes a second inner bent portion and a second outer bent portion, the second outer bent portion is located on an outer side of the second inner bent portion, the second inner bent portion is respectively connected to the second hair strand layer and the third hair strand layer, and the second outer bent portion is respectively connected to the connecting hair strand layer and the fourth hair strand layer.

In an embodiment of this application, the hair extension fixing portion further includes an additional thread, and the additional thread is disposed between the third hair strand layer and the second hair strand layer.

In an embodiment of this application, the hair weft fixing portion further includes an additional thread, and the additional thread is disposed between the third hair strand layer and the fourth hair strand layer.

To achieve at least one of the foregoing objectives of this application, this application provides a hair extension, including:

a hair extension fixing portion, where the hair extension fixing portion is located on a side of the hair extension, and the hair extension fixing portion fixes a group of scattered hairs in a hair strand folding method to form a multi-layer hair strand structure; and a hair extension body, where the hair extension body is adjacent to the hair extension fixing portion, and the hair extension body is connected to a hair strand layer.

In an embodiment of this application, the hair extension fixing portion includes at least two hair strand layers, and the hair extension fixing portion is fixed by stitching two ends of the hair extension fixing portion respectively via stitching threads.

In an embodiment of this application, the hair extension fixing portion includes four hair strand layers, the hair extension fixing portion is disposed at an end, closer to an edge of the hair extension and farther away from the hair extension body, of the hair extension, the four hair strand layers are stitched together, and an end, closer to the hair extension body, of the hair extension fixing portion is fixed in two stitching methods respectively.

In an embodiment of this application, at the end, closer to the hair extension body, of the hair extension fixing portion, two hair strand layers of the hair extension fixing portion are fixed by the stitching threads, and other two hair strand layers of the hair extension fixing portion are respectively fixed via stitching threads.

In an embodiment of this application, the hair extension fixing portion further defines a connecting hair strand layer, the connecting hair strand layer is connected to the hair extension body, an end, closer to the hair extension body, of the connecting hair strand layer is fixed via a stitching thread, and an end, farther away from the hair extension body, of the connecting hair strand layer is fixed to other hair strand layers of the hair extension fixing portion via a stitching thread.

In an embodiment of the present invention, the hair extension fixing portion further includes a second hair strand layer, an end, closer to the hair extension body, of the second hair strand layer is fixed via a stitching thread, and an end, farther away from the hair extension body, of the second hair strand layer is fixed to the connecting hair strand layer via a stitching thread.

In an embodiment of this application, the hair extension fixing portion further includes a third hair strand layer and a fourth hair strand layer, ends, closer to the hair extension body, of the third hair strand layer and the fourth hair strand layer are fixed via a second stitching thread, and ends, farther away from the hair extension body, of the third hair strand layer and the fourth hair strand layer are fixed to the connecting hair strand layer and the second hair strand layer via a third stitching thread.

In an embodiment of this application, the hair extension fixing portion further includes an additional thread, the additional thread is disposed between the second hair strand layer and the third hair strand layer to absorb glue, so that inner sides of the second hair strand layer and the third hair strand layer absorb the glue, thereby facilitating fixing of the inner side of the second hair strand layer and the inner side of the third hair strand layer.

In an embodiment of this application, the hair extension fixing portion further includes a second bent portion, the second bent portion is disposed at an end farther away from the hair extension body, the second bent portion further includes an outer hair strand layer and an inner hair strand layer, the outer hair strand layer wraps the inner hair strand layer, the outer hair strand layer is connected to the connecting hair strand layer and the fourth hair strand layer respectively, and the inner hair strand layer is connected to the second hair strand layer and the third hair strand layer respectively.

In an embodiment of this application, the hair extension fixing portion further includes a first bent portion, the first bent portion is disposed on a side closer to the hair extension body, and the first bent portion is respectively connected to the third hair strand layer and the fourth hair strand layer.

In an embodiment of this application, hair cuticles at roots of the hair strands are removed.

In an embodiment of this application, hair cuticles throughout the hair strands are removed.

To achieve at least one of the foregoing objectives of this application, this application provides a hair extension manufacturing method, including the following steps:

S1: fixing a group of scattered hairs at a preset interval via two first stitching threads, where a portion from a hair root of the group of scattered hairs to a first stitching thread farther away from the hair root is defined as a hair extension fixing portion, and other portions of the group of scattered hairs are defined as a hair extension body;

S2: folding the hair extension fixing portion to form a first bent portion, so that the two first stitching threads are located on one side of the first bent portion, where after the hair extension fixing portion is bent, a layer of hair strands connected to the hair extension body is defined as a connecting hair strand layer, and a layer of folded hair strands is defined as a second hair strand layer;

S3: fixing a stitching thread between the first stitching thread and the first bent portion to avoid relative movement of the folded hair extension fixing portion, where the stitching thread is defined as the second stitching thread;

S4: folding the connecting hair strand layer and the second hair strand layer, so that the first bent portion is folded to approach the hair extension body, thereby forming a second bent portion; and S5: fixing a third stitching thread between the second stitching thread and the second bent portion to form a stacked structure, where the stacked structure includes four hair strand layers and the third stitching thread stitches the four hair strand layers.

In an embodiment of this application, the hair extension manufacturing method further includes step S6: applying glue to the stacked structure.

In an embodiment of this application, the method further includes step S3A between step S3 and step S4, where step S3A includes: guiding at least one additional thread, and the additional thread is additionally disposed on an outer side of the second hair strand layer.

In an embodiment of this application, step S4 is replaced with step S4A: folding the connecting hair strand layer and the second hair strand layer, so that the second stitching thread and the two first stitching threads are on one side, to form a second bent portion, where the additional thread is wrapped in the second bent portion.

To achieve at least one of the foregoing objectives of this application, this application provides a hair extension manufacturing apparatus, including:

a scattered hair fixing apparatus, where the scattered hair fixing apparatus unfolds preprocessed scattered hairs and performs first fixing on the unfolded scattered hairs through two first stitching threads at a preset interval, a root portion of the unfolded scattered hairs and a portion fixed by the two first stitching threads are defined as a hair extension fixing portion, and other portions of the unfolded scattered hairs are defined as a hair extension body;

a first folding apparatus, where the first folding apparatus folds the hair extension fixing portion to obtain a first bent portion, and the two first stitching threads are located on a side of the first bent portion after folding;

a first fixing apparatus, where the fixing apparatus fixes the folded hair extension fixing portion, and the first fixing apparatus stitches the folded hair extension fixing portion through a stitching thread;

a second folding apparatus, where the second folding apparatus performs second folding on the folded hair extension fixing portion to form a second bent portion, so that the first bent portion is folded onto the same side as the two first stitching threads;

a second fixing apparatus, where the second fixing apparatus fixes the twice-folded hair extension fixing portion in a stitching manner to form a stacked structure; and a guiding apparatus, where the guiding apparatus is fixed by the twice-folded hair extension fixing portion under guidance of the scattered hair fixing apparatus, to respectively pass through the first folding apparatus, the first fixing apparatus, the second folding apparatus, and the second fixing apparatus.

In an embodiment of this application, the hair extension manufacturing apparatus further includes at least one gluing apparatus, and the gluing apparatus is disposed behind the guiding apparatus and configured to apply glue to the twice-folded hair extension fixing portion.

In an embodiment of this application, the hair extension manufacturing apparatus further includes an additional thread supply apparatus, to better allow glue to adhere to the additional thread via the additional thread, thereby better fixing the hair strands at the edge of the hair extension.

In an embodiment of this application, the additional thread supply apparatus supplies the additional thread to the first fixing apparatus, so that the second folding apparatus wraps the additional thread in the second bent portion.

In an embodiment of this application, there is a height difference between the first fixing apparatus and the first folding apparatus, the first folding apparatus further includes a first lifting apparatus, and the first lifting apparatus is located before the first fixing apparatus, so that the hair extension fixing portion has space for flipping.

In an embodiment of this application, the first folding apparatus further includes a first folding portion, the first folding portion is located between the first lifting apparatus and the first fixing apparatus, and the first folding portion flips the hair extension fixing portion into a vertical posture.

In an embodiment of this application, the first folding apparatus further includes a first folding portion, the folding portion is located between a second flipping apparatus and the first fixing apparatus, and the folding portion comes into contact with the middle of the two first stitching threads of the hair extension fixing portion, so that the first stitching thread above the fixing portion moves toward the first stitching thread below the fixing portion, thereby forming a folding tendency.

In an embodiment of this application, the first fixing apparatus further includes a first pressing apparatus and a first stitching apparatus, a front end of the first pressing apparatus is lifted upward to form a guiding entrance for the hair extension fixing portion to pass through the first pressing apparatus to be folded, and the first pressing apparatus tightly presses and folds the folded hair extension fixing portion, so that the first fixing apparatus stitches the folded hair extension fixing portion.

In an embodiment of this application, the second lifting apparatus is disposed between the first fixing apparatus and the second fixing apparatus to lift the folded hair extension fixing portion to a preset height.

In an embodiment of this application, the second fixing apparatus first refolds the folded hair extension fixing portion, and then fixes the twice-folded hair extension fixing portion via a stitching thread, and the twice-folded hair extension fixing portion forms a second bent portion.

BRIEF DESCRIPTION OF THE DRAWINGS

The following describes embodiments of this application in detail with reference to accompanying drawings, to make these and/or other aspects and advantages of this application clearer and easier to understand, where.

DETAILED DESCRIPTION

The following content clearly and completely describes technical solutions in embodiments of this application with reference to accompanying drawings in the embodiments of this application. Apparently, the described embodiments are merely some but not all of the embodiments of this application. Based on the embodiments in this application, all other embodiments obtained by those of ordinary skills in the art without creative efforts shall fall within the protection scope of this application.

In this application, terms such as "first" and "second" are intended to distinguish between different objects but do not indicate a particular order. In addition, the terms such as "include" and "have" and any variations thereof are intended to cover non-exclusive inclusions.

Although terms such as "front", "rear", "left", "right", "upper", and "lower" may be used in this specification when various exemplary features and elements are described, these terms are used herein for convenience based on, for example, exemplary directions shown in the figures and/or directions in typical use. No content in this specification shall be construed as requiring specific three-dimensional or spatial orientations of structures to fall within the scope of the claims.

It should be noted that fixing of an element to another element includes direct fixing of the element to another element, or fixing of the element to another element through at least one intermediate element. Connection of an element to another element includes direct connection of the element to another element, or connection of the element to another element through at least one intermediate element.

Figure 1:
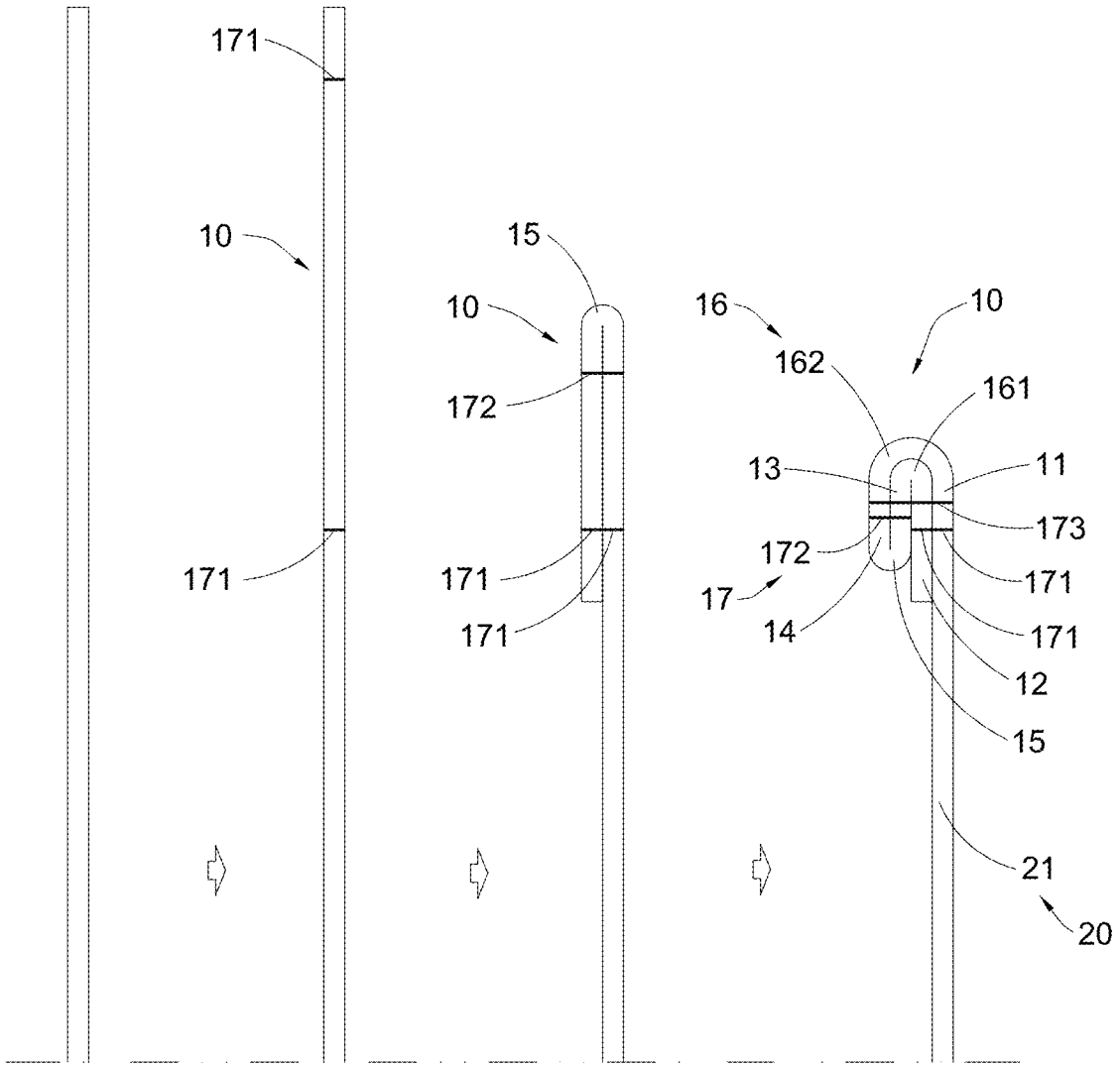
FIG. 1 is a schematic diagram of a hair extension manufacturing process according to an embodiment of this application.
Figure 2:
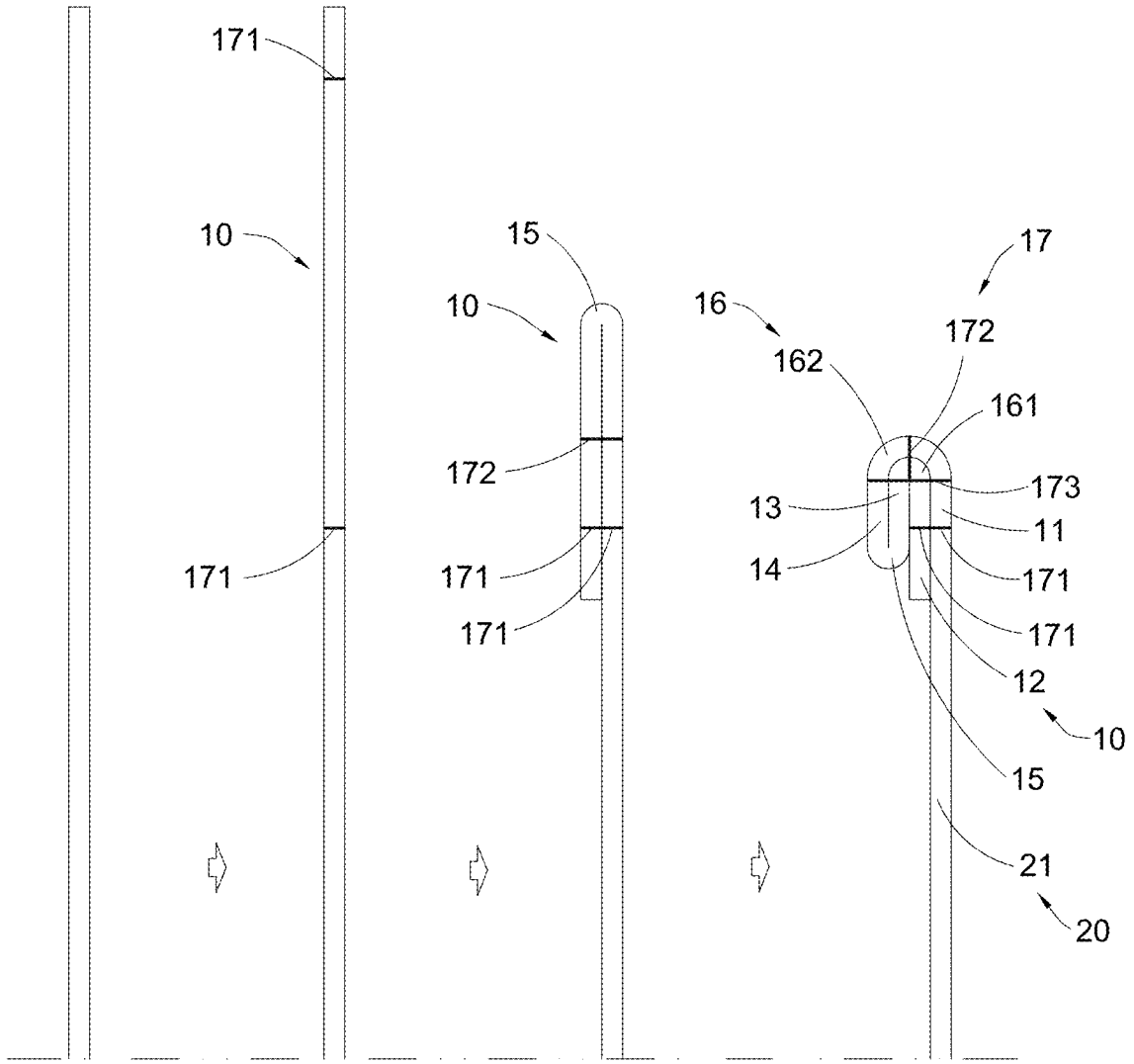
FIG. 2 is a schematic diagram of a hair extension manufacturing process according to another embodiment of this application.
Figure 3:
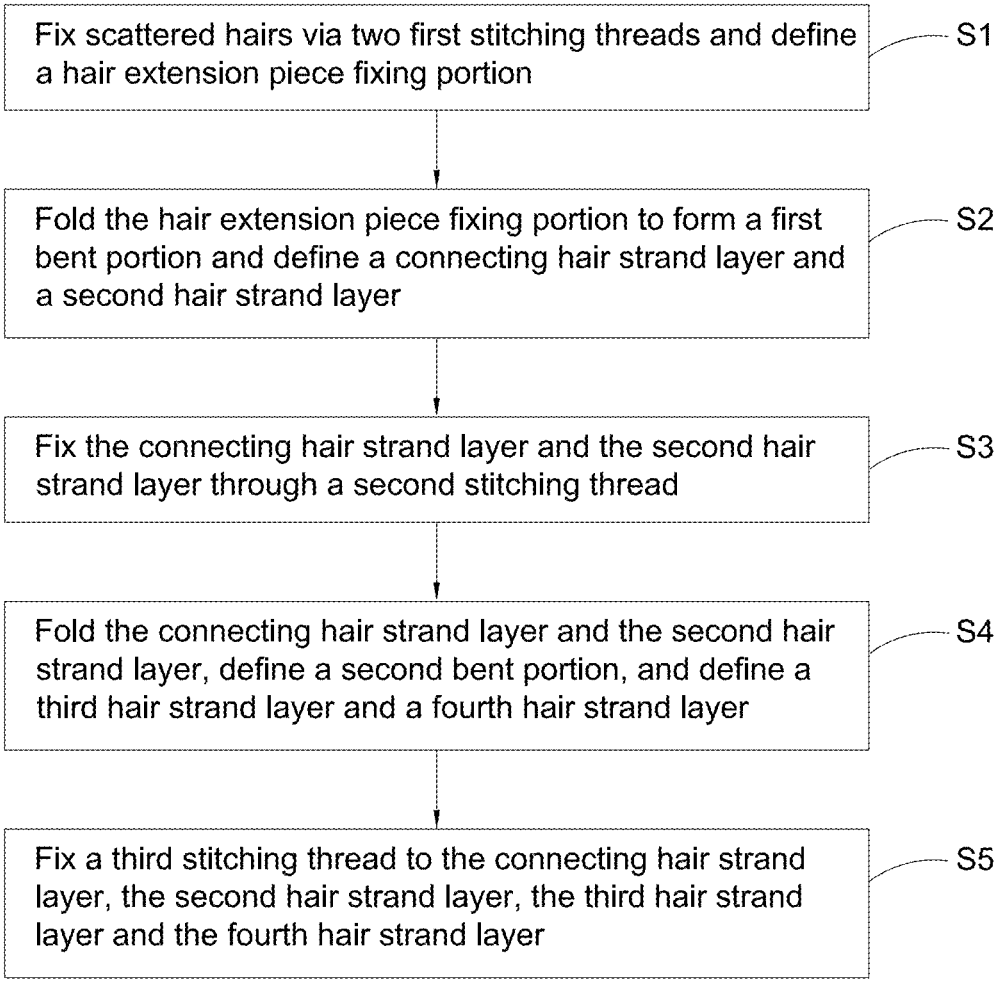
FIG. 3 is a flowchart of a hair extension manufacturing process according to an embodiment of this application.

FIG. 1 shows a schematic diagram of a hair extension according to this application, indicating a formation process of a multi-layer structure of a hair extension fixing portion. The hair extension further includes: a hair extension fixing portion 10 and a hair extension body 20, where the hair extension fixing portion 10 is connected to the hair extension body 20. The hair extension fixing portion 10 further includes a connecting hair strand layer 11, a second hair strand layer 12, a third hair strand layer 13, and a fourth hair strand layer 14. The connecting hair strand layer 11 is connected to the hair extension body 20. The second hair strand layer 12 is adjacent to the connecting hair strand layer 11, the third hair strand layer 13 is adjacent to the second hair strand layer 12, and the fourth hair strand layer 14 is adjacent to the third hair strand layer 13. That is, the second hair strand layer 12 is located between the connecting hair strand layer 11 and the third hair strand layer 13. The third hair strand layer 13 is located between the second hair strand layer 12 and the fourth hair strand layer. The hair extension fixing portion 10 further includes a first bent portion 15 and a second bent portion 16, and the first bent portion 15 is respectively connected to the third hair strand layer 13 and the fourth hair strand layer. The second bent portion 16 further includes a second inner bent portion 161 and a second outer bent portion 162. The second inner bent portion 161 is respectively connected to the second hair strand layer 12 and the third hair strand layer 13. The second outer bent portion 162 is respectively connected to the fourth hair strand layer 14 and the connecting hair strand layer 11. The hair extension fixing portion 10 further includes two first stitching threads 171, and the two first stitching threads 171 are respectively disposed on a side closer to the hair root. Specifically, one of the first stitching threads 171 is fixed to the connecting hair strand layer 11, and another first stitching thread 171 is fixed to the second hair strand layer 12. The hair extension fixing portion 10 further includes a second stitching thread 172. As shown in FIG. 1, the second stitching thread 172 is disposed between the first bent portion 15 and the second bent portion 16. In another preferred embodiment of this application, as shown in FIG. 2, the second stitching thread 172 is disposed at the second bent portion 16. The second stitching thread 172 fixes the fourth hair strand layer 14 and the third hair strand layer 13. The second stitching thread 172 and the two first stitching threads 171 are respectively located on a side, closer to the hair extension body 20, of the hair extension fixing portion 10. The hair extension fixing portion 10 further includes a third stitching thread 173. The third stitching thread 173 stitches the connecting hair strand layer 11, the second hair strand layer 12, the third hair strand layer 13, and the fourth hair strand layer 14. Preferably, the third stitching thread 173 is disposed in the middle between the second stitching thread 172 and the second bent portion 16. In another preferred embodiment of this application, the third stitching thread 173 is disposed on a side, farther away from the connecting hair strand layer, of the second bent portion 16. The hair weft fixing portion 10 fixes the hair strands via a multi-layer structure, so that the hair strands are stably fixed and uneasy to fall off.

In a preferred embodiment of this application, the second hair strand layer 12, the third hair strand layer 13, and the fourth hair strand layer 14 are respectively formed by folding the connecting hair strand layer 11. That is, firstly, the connecting hair strand layer 11 is defined by the two first stitching threads 171. Secondly, the connecting hair strand layer 11 is folded to form the first bent portion 15. In addition, the two first stitching threads 171 are located on the same side. The two first stitching threads 171 are adjacent. Preferably, the two first stitching threads 171 are aligned. The hair strands of the folded connecting hair strand layer 11 are defined as the second hair strand layer 12. The second stitching thread 172 fixes the second hair strand layer 12 and the connecting hair strand layer 11 respectively. Preferably, the second stitching thread 172 is disposed in the middle between the first stitching thread 171 and the first bent portion 15. The second hair strand layer 12 and the connecting hair strand layer 11 are folded, so that the first bent portion 15 and the two first stitching threads 171 are on located the same side, thereby forming the second bent portion 16. After being folded, hair strands of the second hair strand layer 12 come into contact with each other, and after being folded, the connecting hair strand layer 11 wraps the second hair strand layer 12, to form a four-layer structure. The connecting hair strand layer 11 connected to the first bent portion 15 is defined as the fourth hair strand layer 14. The second hair strand layer 12 connected to the first bent portion is defined as the third hair strand layer 13. The third stitching thread 173 respectively fixes the connecting hair strand layer 11, the second hair strand layer 12, the third hair strand layer 13, and the fourth hair strand layer 14. Preferably, the third stitching thread 173 is disposed in the middle between the second stitching thread 172 and the second bent portion 16. In another preferred embodiment of this application, the third stitching thread is disposed adjacent to the second bent portion 16. The hair extension fixing portion 10 is formed in the foregoing manner. The hair extension fixing portion 10 is located on one side edge of the hair weft.

The hair extension fixing portion 10 is provided with a multi-layer folded structure, and the multi-layer folded structure ensures that the hair strands of the hair extension body 20 are uneasy to fall off. Specifically, the hair extension body 20 further includes a group of main hair strands 21. The main hair strands 21 are connected to connecting hair strands 111 of the connecting hair strand layer 11. The connecting hair strand layer 11 is connected to the fourth hair strand layer 14 via the second outer bent portion 162. The fourth hair strand layer 14 is connected to the third hair strand layer 13 via the first bent portion 15. The third hair strand layer 13 is connected to the second hair strand layer 12 via the second inner bent portion 161. The second hair strand layer 12 respectively comes into contact with the connecting hair strand layer 11 and the third hair strand layer 13. The third hair strand layer 13 respectively comes into contact with the fourth hair strand layer 14 and the second hair strand layer 12. Through the folding method, a direction of force acting on the connecting hair strand layer 11 is opposite to that acting on the second hair strand layer 12; a direction of force acting on the second hair strand layer 12 is opposite to that acting on the third hair strand layer 13; and a direction of force acting on the third hair strand layer 13 is opposite to that acting on the fourth hair strand layer 14. That is, to detach from the hair extension fixing portion 10, the hair strands of the hair extension body 20 need to overcome resistance of the first stitching thread 171, the second stitching thread 172, and the third stitching thread 173 respectively, pass through the second hair strand layer 12, the third hair strand layer 13, the fourth hair strand layer 14, and the connecting hair strand layer 11 in sequence, and finally leave the hair extension fixing portion 10. In a process where the force acting on the hair strands is transferred to the second hair strand layer 12, not only the resistance of the first stitching thread 171, the second stitching thread, and the third stitching thread needs to be overcome, but also resistance exerted by the second hair strand layer 12 on the connecting hair strand layer 11 and the third hair strand layer 13 respectively and the resistance exerted by the third hair strand layer 13 on the second hair strand layer 12 and the fourth hair strand layer 14 respectively needs to be overcome. In this way, a stable structure is provided to prevent the hair strands from detaching from the hair extension fixing portion.

Figure 4:
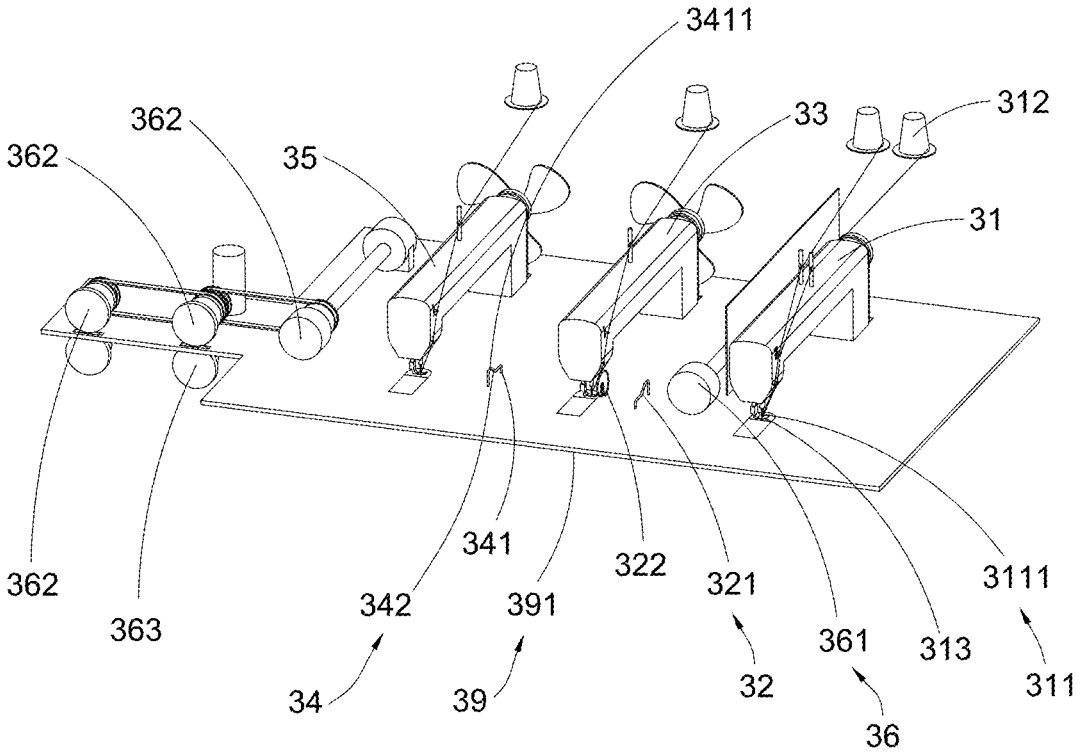
FIG. 4 is a schematic diagram of a hair extension manufacturing apparatus according to an embodiment of this application.
Figure 5:
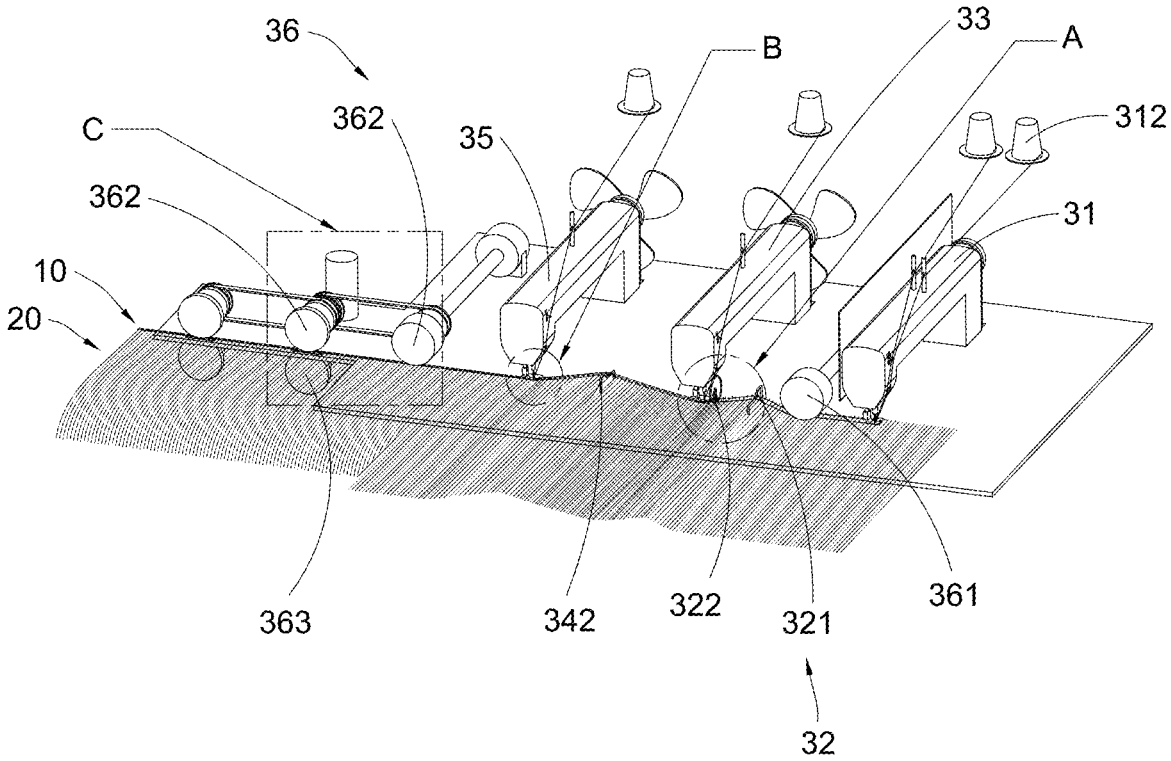
FIG. 5 is a schematic diagram of manufacturing a hair extension via a hair extension manufacturing apparatus according to an embodiment of this application.
Figure 6:
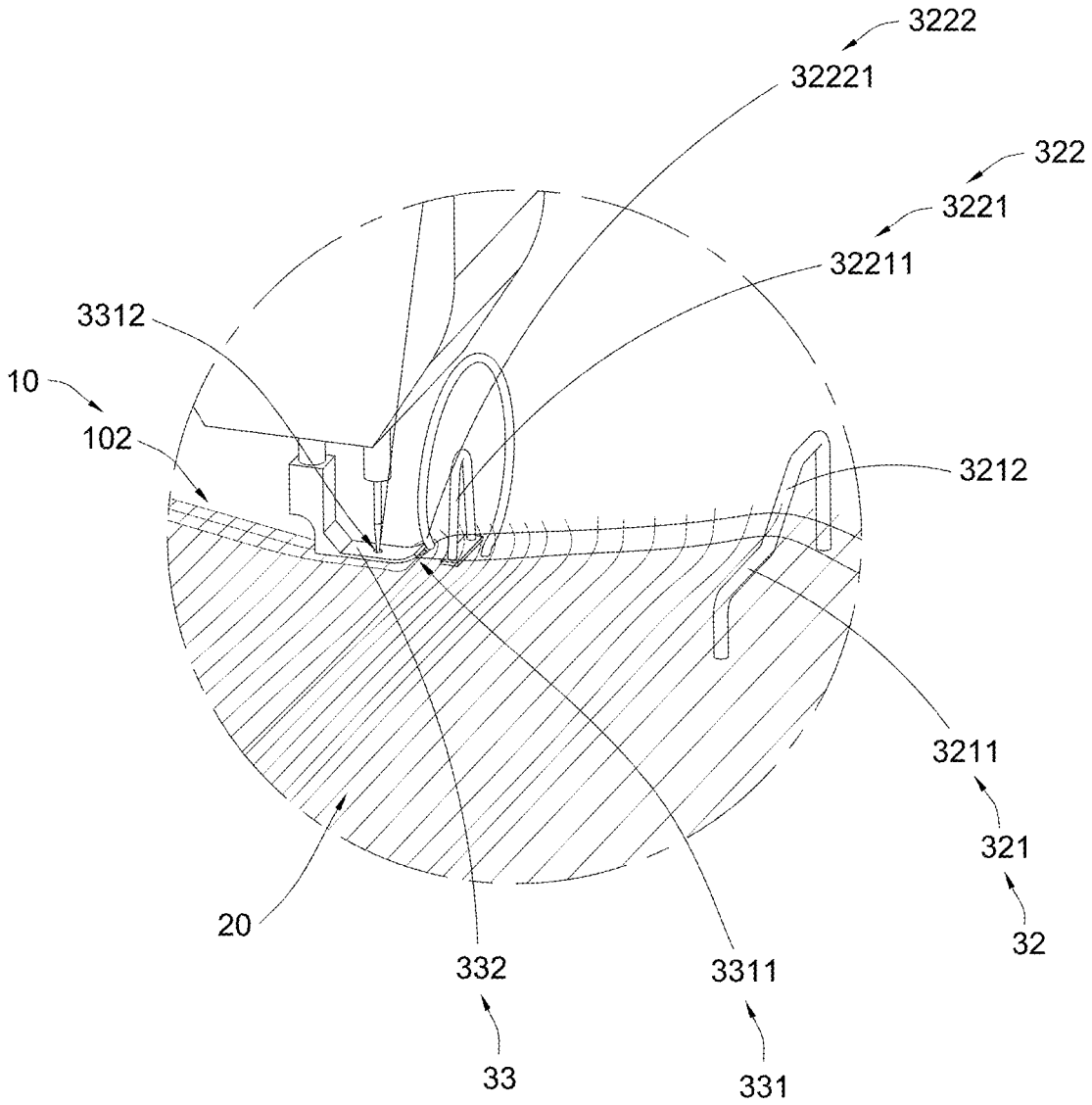
FIG. 6 is an enlarged schematic diagram of a first folding apparatus of a hair extension manufacturing apparatus according to an embodiment of this application.
Figure 7:
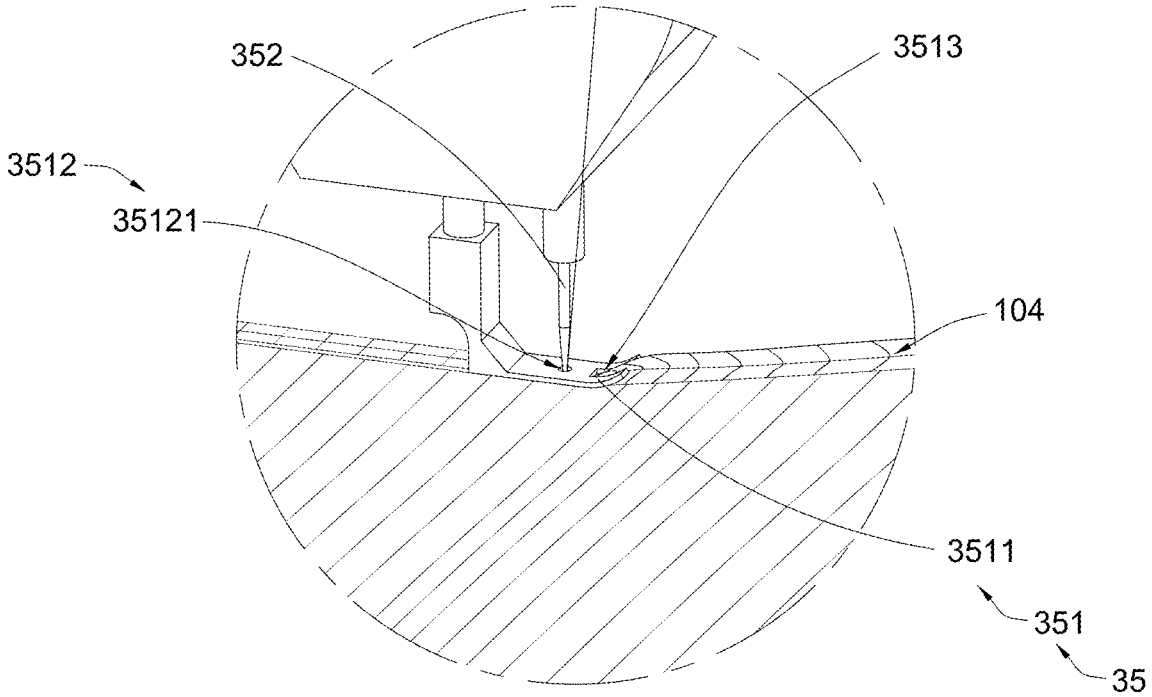
FIG. 7 is an enlarged schematic diagram of a second folding apparatus of a hair extension manufacturing apparatus according to an embodiment of this application.

FIG. 4 to FIG. 6 show a preferred embodiment of a hair extension manufacturing apparatus according to this application. The hair extension manufacturing apparatus 3 in this application includes a scattered hair fixing apparatus 31, a first folding apparatus 32, a first fixing apparatus 33, a second lifting apparatus 34, a second fixing apparatus 35, a guiding apparatus 36, and a workbench 39. The scattered hair fixing apparatus 31, the first folding apparatus 32, the first fixing apparatus 33, the second lifting apparatus 34, the second fixing apparatus 35, and the guiding apparatus 36 are respectively installed onto the workbench 39. The first folding apparatus 32 is installed between the scattered hair fixing apparatus 31 and the first fixing apparatus 33. The second lifting apparatus 34 is installed between the first fixing apparatus 33 and the second fixing apparatus 35.

The scattered hair fixing apparatus 31 further includes a scattered hair stitching apparatus 311, a thread supply apparatus 312, and a scattered hair flattening apparatus 313. The thread supply apparatus 312 and the scattered hair flattening apparatus 313 are disposed below the scattered hair stitching apparatus. The thread supply apparatus 312 supplies threads for stitching flattened scattered hairs. The stitching threads provided by the thread supply apparatus 312 are connected to the guiding apparatus 36. The guiding apparatus 36 guides the stitching threads provided by the thread supply apparatus 312 to pass through the first folding apparatus 32, the first fixing apparatus 33, the second lifting apparatus 34, and the second fixing apparatus 35 respectively. In this way, the guiding apparatus 36 further provides pulling force to act on the stitching threads provided by the thread supply apparatus 312. In a preferred embodiment of this application, the scattered hair stitching apparatus 311 provides two stitching needles 3111. The two stitching needles 3111 are disposed at a preset interval. The thread supply apparatus 312 provides two stitching threads, and the two stitching needles 3111 use the two stitching threads to stitch the flattened scattered hairs, thereby forming the connecting hair strand layer 11. After being stitched into the flattened scattered hairs, the two stitching threads are defined as the two first stitching threads 171. Further, the guiding apparatus 36 pulls the two first stitching threads 171 to guide the connecting hair strand layer 11 to the first folding apparatus 32. Preferably, the scattered hairs used in this application are human hairs. The scattered hair fixing apparatus 31 fixes a root portion of the scattered hair. Specifically, the scattered hair stitching apparatus 311 stitches the two first stitching threads 171 near the root portions of the scattered hairs to define the hair extension fixing portion 10. That is, the root portions of the scattered hairs stitched by the two first stitching threads 171 are defined as the connecting hair strand layer 11. The connecting hair strand layer 11 is guided to the first folding apparatus 32 by the guiding apparatus 36. In a preferred embodiment of this application, the scattered hair fixing apparatus 31 is implemented as a double-needle sewing machine. The scattered hair stitching apparatus 311 is implemented as two stitching needles 3111. The thread supply apparatus 312 is an apparatus for supply threads for the sewing machine.

The first folding apparatus 32 folds the connecting hair strand layer 11 to form the first bent portion 15. The first folding apparatus 32 further includes a first lifting apparatus 321 and a first folding portion 322. The first folding portion 322 is disposed close to the first fixing apparatus 33. The first lifting apparatus 321 is disposed between the first fixing apparatus 33 and the scattered hair fixing apparatus. It is worth mentioning that, to fold the connecting hair strand layer 11, it is necessary to apply force to the connecting hair strand layer to flip and then fold the connecting hair strand layer 11. In a preferred embodiment of this application, the guiding apparatus 36 provides pulling force to the connecting hair strand layer 11 to guide the connecting hair strand layer 11 to pass through the first folding portion 322. In addition, a height difference is set for the scattered hair fixing apparatus 31 and the first fixing apparatus 33 to change the direction of the force, thereby folding the connecting hair strand layer 11. Specifically, a distance from the first fixing apparatus 33 to a first side edge 391 of the workbench 39 is less than a distance from the scattered hair fixing apparatus 31 to the first side edge 391 of the workbench 39. In this way, the connecting hair strand layer 11 is flipped and folded through the positional difference between the scattered hair fixing apparatus 31 and the first fixing apparatus 33 by applying the pulling force to the connecting hair strand layer 11 via the guiding apparatus 36.

The guiding apparatus 36 further includes a connection guiding apparatus 361, and the connection guiding apparatus 361 is disposed between the first lifting apparatus 321 and the scattered hair fixing apparatus 31. In a preferred embodiment of this application, the connection guiding apparatus 361 is a connection guiding wheel. The connection guiding wheel 361 guides the connecting hair strand layer to the first lifting apparatus 321 through rotation. The connection guiding wheel 361 is disposed above the connecting hair strand layer 11. During a conveying process, the connection guiding wheel 361 rotates on the connecting hair strand layer 11, so that the connecting hair strand layer 11 moves toward the first lifting apparatus 321. The first lifting apparatus 321 has a preset height to lift the connecting hair strand layer 11, so that a height difference is formed between the connecting hair strand layer 11 and the first fixing apparatus 33 to facilitate flipping of the connecting hair strand layer 11. The first lifting apparatus 321 further includes a flat portion 3211 and an inclined portion 3212. One end of the flat portion 3211 extends obliquely upward to form the inclined portion 3212. When the connecting hair strand layer 11 is placed on the flat portion 3211, and the connecting hair strand layer 11 is laid flat on the flat portion 3211. It is worth noting that the two first stitching threads 171 of the connecting hair strand layer 11 are placed on the flat portion 3211 in a horizontal state. If the connecting hair strand layer 11 is placed on the inclined portion 3212, the connecting hair strand layer 11 has a flipping tendency.

The first folding portion 322 further includes a first flipping element 3221 and a first folding element 3222. The first folding element 3222 is additionally disposed at an end of the first flipping element 3221. The first flipping element 3221 is disposed near the first fixing apparatus 33 to rotate the connecting hair strand layer 11 into a vertical state. The folding element 3222 exerts force on the connecting hair strand layer 11 between the first flipping element 3221 and the first fixing apparatus 33, so that the connecting hair strand layer 11 is folded. In a preferred embodiment of this application, the first flipping element 3221 has a side flipping portion 32211. The connecting hair strand layer 11 is subjected to pulling force to fit the side flipping portion 32211, thereby flipping the connecting hair strand layer 11 into a vertical state. The first folding element 3222 further includes a folding end 32221, and the folding end 32221 is disposed between the first flipping element 3221 and the first fixing apparatus 33. The folding end 32221 is disposed to face away from the first side 391 of the workbench 39. In this way, the connecting hair strand layer 11 bends toward the first side 391 of the workbench 39. Preferably, a connecting thread between the side flipping portion 32211 and the first fixing apparatus 33 is defined. The connecting hair strand layer 11 moves along the connecting thread to the first fixing apparatus 33. A contact position between the folding end 32221 and the connecting hair strand layer 11 is on the connecting thread and is farther away from the first side of the workbench 39. In this way, the connecting hair strand layer 11 has a tendency to bend toward the first side 391 of the workbench 39. Preferably, the folding end 32221 comes into contact with the middle of the two first stitching threads 171 of the connecting hair strand layer 11, to fold the two first stitching threads 171 at the middle of the two first stitching threads 171, so that the two first stitching threads 171 enter an adjacent state.

The first fixing apparatus 33 further includes a first pressing apparatus 331 and a first stitching apparatus 332. A front end of the first pressing apparatus 331 extends upward to form a guiding entrance 3311, to allow the connecting hair strand layer with a folding tendency to enter the pressing apparatus 331. The first pressing apparatus 331 applies pressure to the connecting hair strand layer 11 with a folding tendency to fold the connecting hair strand layer 11 with such a folding tendency. After the connecting hair strand layer 11 is folded, the pressing apparatus 331 fixes the folded connecting hair strand layer 11. The folded portion of the connecting hair strand layer 11 is defined as the first bent portion 15. The first stitching apparatus 332 stitches the folded connecting hair strand layer 11. In a preferred embodiment of the present invention, the first stitching apparatus 332 performs stitching at a position close to the first bent portion 15. The stitching thread at the first bent portion 15 is defined as the second stitching thread 172. The folded connecting hair strand layer is defined as the second hair strand layer 12. The second stitching thread 172 stitches the connecting hair strand layer 11 and the second hair strand layer 12. A semi-finished product with the connecting hair strand layer 11 and the second hair strand layer 12 stitched by the second stitching thread 172 is defined as a fixing portion intermediate 102. The first stitching apparatus 332 is disposed above the pressing apparatus 331. The pressing apparatus 331 is provided with a through hole 3312, and the first stitching apparatus 332 passes through the through hole 3312, the connecting hair strand layer 11, and the second hair strand layer 12 to perform stitching. In a preferred embodiment of this application, the first fixing apparatus 33 is implemented as a single-needle sewing machine.

The second lifting apparatus 34 is disposed between the second fixing apparatus 35 and the first fixing apparatus 33. The second lifting apparatus 34 is disposed on a side farther away from a connection center of the second fixing apparatus 35 and the first fixing apparatus 33. In this way, a height difference is formed for the fixing portion intermediate 102 after the fixing portion intermediate passes through the second lifting apparatus 34, so that the pulled fixing portion intermediate 102 is subjected to flipping force at the second fixing apparatus 35 to fold the fixing portion intermediate 102. Further, the second lifting apparatus 34 has a preset height, so that the fixing portion intermediate 102 has folding space for folding. In a preferred embodiment of this application, the second lifting apparatus 34 is a support frame. The second lifting apparatus 34 further includes a lifting portion 341 and a restraint portion 342. The restraint portion 342 is on one side of the lifting portion 341. Preferably, the restraint portion 342 is close to the first side 391 of the workbench 39, and the restraint portion 342 is higher than the lifting portion 341, so that a connecting side 3411 between the restraint portion 342 and the lifting portion 341 prevents the fixing portion intermediate 102 from moving toward the first side 391 of the workbench 39.

The second fixing apparatus 35 further includes a second folding apparatus 351 and a second stitching apparatus 352, and the second stitching apparatus 352 is located above the second folding apparatus 351. The second folding apparatus 351 is provided with a second through hole 35121 for the second stitching apparatus 352 to pass through the second folding apparatus 351 for stitching. The second folding apparatus 351 further includes two folding elements 3511 and a stitching portion 3512. The two folding elements 3511 are respectively adjacent to the stitching portion 3512. The second stitching apparatus 352 is disposed above the stitching portion 3512. The second through hole 35121 is located in the stitching portion 3512. Further, the two ends of the two folding elements 3511 are respectively lifted upward. The second folding apparatus 351 further has a folding channel 3513, and the folding channel 3513 is defined between the two folding elements 3511. There is an included angle between an opening direction of the folding channel 3513 and a moving direction of the fixing portion intermediate 102, so that when the fixing portion intermediate 102 enters the folding channel 3513, a vertical portion of the fixing portion intermediate 102 comes into contact with the folding element 3511 on a side. When passing through the folding channel 3513, the vertical portion in contact with the folding element 3511 bends toward the main hair strands 21. The folding element then moves toward the stitching portion 3512. The stitching portion 3512 presses the bent fixing portion intermediate 102. The pressed fixing portion intermediate 102 is pressed by the stitching portion 3512, and moves away from the two folding elements 3511 under the pulling force. The second stitching apparatus 352 stitches the folded fixing portion intermediate 102 through the second through hole 35121. After stitching, the stitching thread is defined as the third stitching thread 173. The folded fixing portion intermediate 102 has four hair strand layers. The four hair strand layers are respectively the fourth hair strand layer 14, the third hair strand layer 13, the second hair strand layer 12, and the connecting hair strand layer 11. The third stitching thread 173 stitches the fourth hair strand layer 14, the third hair strand layer 13, the second hair strand layer 12, and the connecting hair strand layer 11. After stitching via the third stitching thread 173, the bent fixing portion intermediate 102 is defined as the hair extension fixing portion 10.

The guiding apparatus 36 further includes a second guiding wheel 362, and the second guiding wheel 362 presses against the hair extension fixing portion 10 to pull the hair extension fixing portion 10 to move away from the second fixing apparatus 35. The guiding apparatus 36 further includes at least one guiding gluing wheel 363. A glue supply portion is disposed below the guiding gluing wheel 363. The hair extension fixing portion 10 is guided by the guiding gluing wheel 363 to pass through the glue supply portion, so that glue supplied by the glue supply portion is applied to the hair extension fixing portion 10. In addition, the guiding gluing wheel 363 provides pressure to the hair extension fixing portion 10, so that the supplied glue more easily permeates into the hair extension fixing portion 10. The guiding gluing wheel 363 further provides pulling force to guide the hair extension fixing portion 10 to move away from the second fixing apparatus 35, so that the entire hair extension fixing portion 10 is glued. In a preferred embodiment of this application, the glue supply portion guides the glue to a surface of the guiding gluing wheel 363. In another preferred embodiment of this application, the glue supply portion is implemented as a glue storage tank, and the guiding gluing wheel 363 is placed in the glue storage tank, so that the surface of the guiding gluing wheel 363 is glued.

Figure 8A:
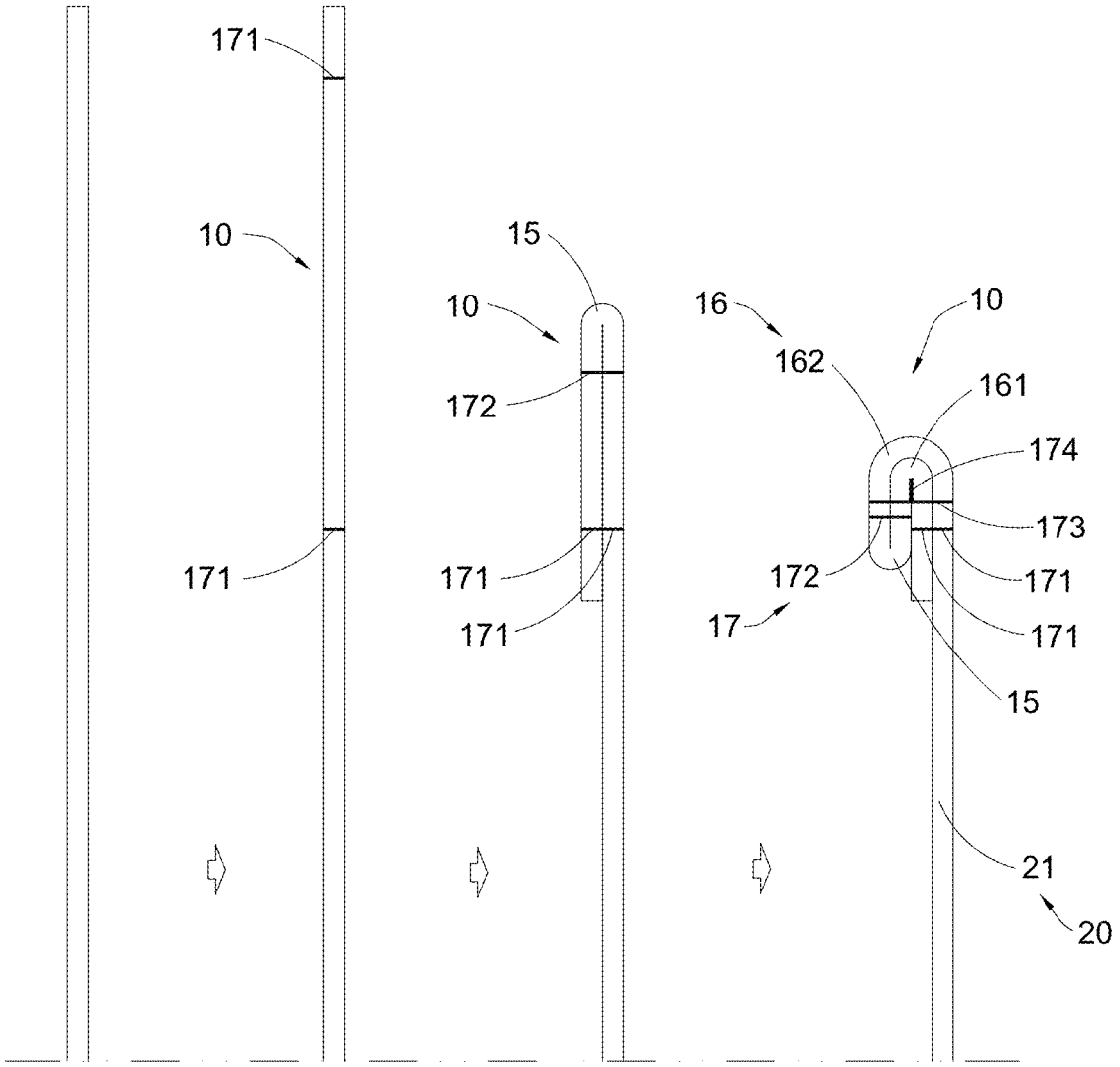
FIG. 8A is a schematic diagram of a hair extension manufacturing process according to another embodiment of this application.
Figure 8B:
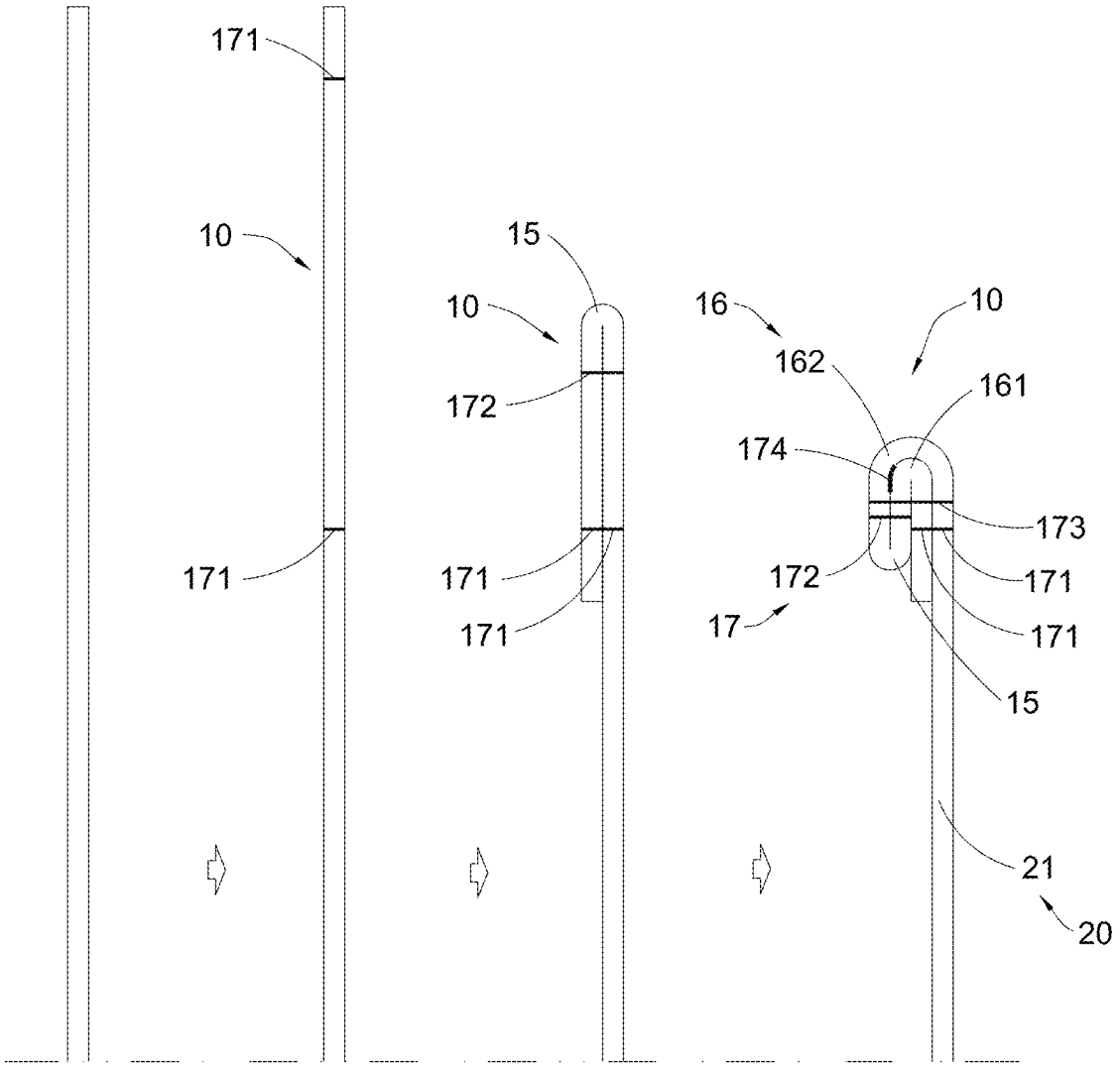
FIG. 8B is a schematic diagram of a hair extension piece manufacturing process according to still another embodiment of this application.

The hair extension in this application further includes at least one additional thread 174. As shown in FIG. 8A, the additional thread 174 is disposed between the second hair strand layer 12 and the third hair strand layer 13. The additional thread 174 is added, so that the hair extension fixing portion 10 has enhanced toughness and is less likely to be damaged when subjected to horizontal pulling force. In addition, during the gluing process, the additional thread 174 allows glue to permeate into the additional thread 174, and then further permeate through a surface of the additional thread 174 to an inner side of the second hair strand layer 12 and an inner side of the third hair strand layer 13, to better fix the second hair strand layer 12 and the third hair strand layer. In this way, durability of the hair extension fixing portion 10 is enhanced. As shown in FIG. 8B, in another preferred embodiment of this application, the additional thread 174 is disposed between the fourth hair strand layer 14 and the third hair strand layer 13. Preferably, the additional thread 174 is disposed at the second bent portion 16. In another preferred embodiment of this application, the additional thread 174 is disposed between the connecting hair strand layer 11 and the second hair strand layer 12.

Figure 9:
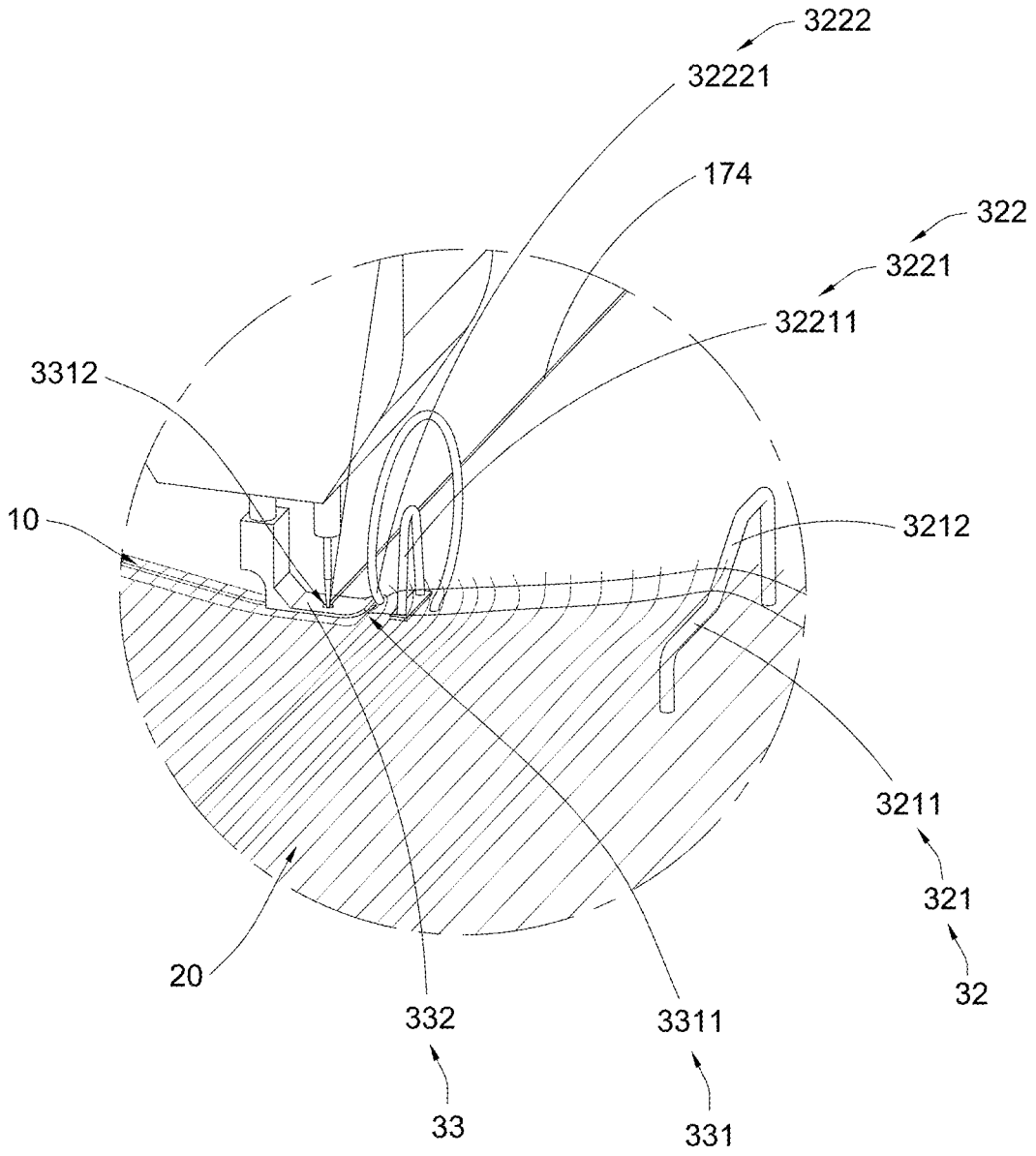
FIG. 9 is a partially enlarged schematic diagram of a second fixing apparatus of a hair extension manufacturing apparatus according to another embodiment of this application.
Figure 10:
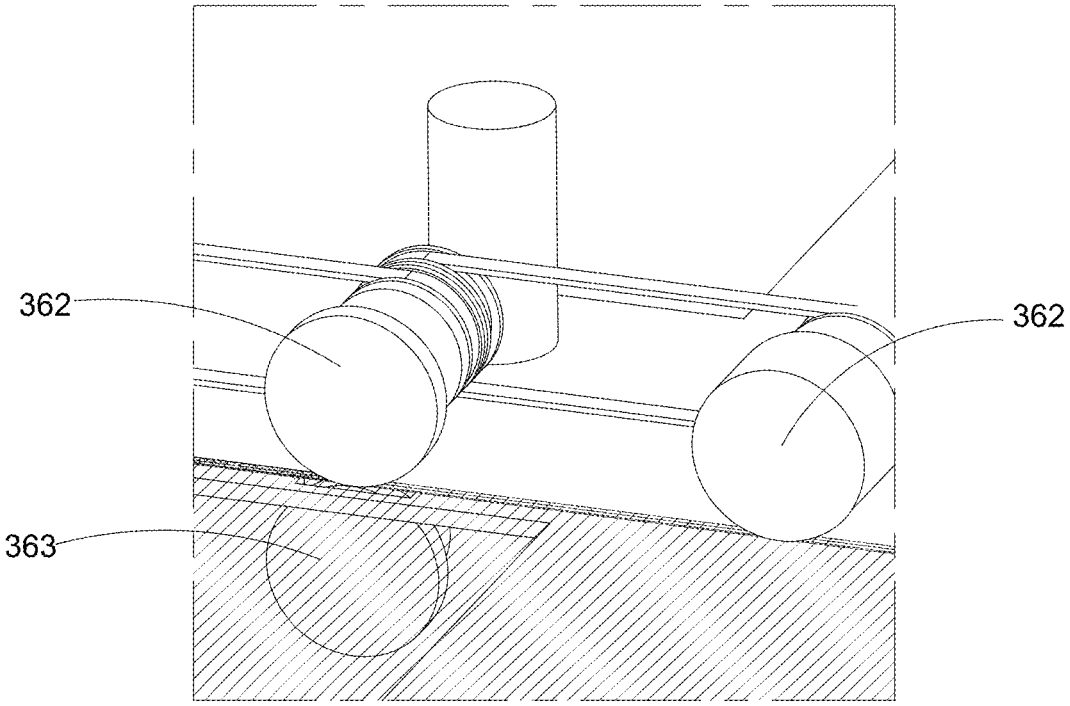
FIG. 10 is a partially enlarged schematic diagram of a guiding apparatus of a hair extension manufacturing apparatus according to an embodiment of this application.

As shown in FIG. 9, after the hair extension fixing portion 10 is subjected to first folding, the additional thread 174 is guided to the folded hair extension fixing portion 10. The additional thread 174 is guided to the second lifting apparatus 34 along with the folded hair extension fixing portion 10. Specifically, the additional thread 174 is guided to the lifting portion 341 along with the folded hair extension fixing portion 10, so that there is a height difference between the folded hair extension fixing portion 10 and the workbench 39, thereby facilitating re-flipping of the folded hair extension fixing portion 10. The additional thread 174 is guided to the second folding apparatus 351 along with the folded hair extension fixing portion 10. The second folding apparatus 351 folds the folded hair extension fixing portion 10 again. It is worth mentioning that when the folded hair extension fixing portion 10 is folded again, the additional thread 174 is wrapped inside the hair extension fixing portion 10 after the second folding. As shown in FIG. 8A, the twice-folded hair extension fixing portion 10 is guided to the guiding gluing wheel 363. The glue provided by the glue supply portion permeates from a side of the twice-folded hair extension fixing portion 10 onto a side, closer to the guiding gluing wheel 363, inside the hair extension fixing portion 10 through the guiding gluing wheel 363. Through the additional thread 174, the glue further comes into contact with the other side, farther away from the guiding gluing wheel 363, inside the hair extension fixing portion 10, to better fix the side, farther away from the glue supply portion 37, inside the hair extension fixing portion by the glue as well. This enhances toughness of the hair extension fixing portion 10 and prevents damage of the hair extension caused due to horizontal stretching. This application further provides a hair extension manufacturing method, including the following steps:

S1: Fix a group of scattered hairs at a preset interval via two first stitching threads, where the group of scattered hairs is fixed at the preset interval via the two first stitching threads respectively, a portion from a hair root of the group of scattered hairs to a first stitching thread farther away from the hair root is defined as a hair extension fixing portion, and other portions of the scattered hairs are defined as a hair extension body.

Specifically, before the group of scattered hairs is fixed, the group of scattered hairs is treated in advance, so that root portions of the group of scattered hairs are aligned. The root portions of the group of scattered hairs are inserted into the scattered hair fixing apparatus 31. This group of scattered hairs is flattened by the scattered hair flattening apparatus 313 and then guided to the scattered hair stitching apparatus 311. The scattered hair stitching apparatus 311 stitches the root portions of the flattened scattered hairs through two first stitching threads 171, to fix the scattered hairs at their root portions. Further, the preset interval is set between the two first stitching threads 171. The interval between the two first stitching threads 171 can be preset according to requirements. The number of scattered hairs fixed by the two first stitching threads 171 can also be preset according to requirements.

S2: Fold the hair extension fixing portion 10 to form a first bent portion 15, so that the two first stitching threads 171 are located on one side of the first bent portion 15, where after the hair extension fixing portion 10 is bent, a layer of hair strands connected to the hair extension body is defined as a connecting hair strand layer 11, and a layer of folded hair strands is defined as a second hair strand layer 12.

The first folding apparatus 32 folds the first stitching thread 171 close to the roots of the scattered hairs toward the first stitching thread 171 close to the hair extension body 20, to form the first bent portion 15. The two first stitching threads 171 are located on a side of the first bent portion 15. After being folded, the two first stitching threads 171 are close to the hair extension body 20. Preferably, the two first stitching threads 171 are aligned.

S3: Fix the connecting hair strand layer 11 and the second hair strand layer 12 respectively at the bent portion through the second stitching thread 172 to form a fixing portion intermediate 102. The fixing portion intermediate 102 refers to the hair extension fixing portion that has been subjected to the first folding.

The first fixing apparatus 33 passes the second stitching thread 172 through the connecting hair strand layer 11 and the second hair strand layer 12 respectively. A position of the second stitching thread 172 is set between the first bent portion 15 and the first stitching thread 171. In a preferred embodiment of this application, the second stitching thread 172 is disposed in the middle between the first stitching thread 171 and the first bent portion 15. In another preferred embodiment of this application, the second stitching thread 172 can also be disposed close to the first bent portion 15.

S4: Fold the connecting hair strand layer 11 and the second hair strand layer 12, where a bent portion of the connecting hair strand layer 11 and the second hair strand layer 12 is defined as a second bent portion, and the second stitching thread and the two first stitching threads are located on the same side.

The second folding apparatus 351 folds the connecting hair strand layer 11 and the second hair strand layer 12 toward the hair extension body 20. If the second stitching thread 172 is disposed in the middle between the first stitching thread 171 and the first bent portion 15, the second stitching thread 172 serves as a folding mark for the second folding apparatus 35. The second folding apparatus 351 performs folding according to the position of the second stitching thread 172 in the middle. If the second stitching thread 172 is close to the first bent portion 15, the second stitching thread 172 is folded toward the hair extension body 20 by the second folding apparatus 35, and the second stitching thread 172 is folded to approach the first stitching thread 171. Preferably, the second stitching thread 172 is aligned with the first stitching thread 171.

S5: Fix a third stitching thread 173 between the first bent portion 15 and the second bent portion 16 to form a stacked structure.

Through the second fixing apparatus 35, the third stitching thread 173 is respectively passed through the folded connecting hair strand layer 11 and second hair strand layer 12, to fix the folded connecting hair strand layer 11 and second hair strand layer 12. The folded connecting hair strand layer 11 and the first bent portion 15 are connected and defined as the fourth hair strand layer 14. The folded second hair strand layer 12 and the first bent portion 15 are connected and defined as the third hair strand layer 13.

In addition to step S5, the method further includes step S6: Apply glue to the stacked structure.

The stacked structure is guided to the guiding gluing wheel 363. The guiding gluing wheel 363 obtains glue from the glue supply portion 37, and during its rotation, the guiding gluing wheel 363 applies the glue to the stacked structure.

The method further includes step S3' between step S3 and step S4. Step S3': Guide an additional thread 174 to the fixing portion intermediate 102, so that the additional thread moves along with the fixing portion intermediate 102. Specifically, the additional thread 174 is guided to the pressing apparatus 331, and a movement direction of the additional thread 174 and a movement direction of the fixing portion intermediate 102 are adjusted through the through hole 3312. Preferably, the additional thread 174 moves along the fixing portion intermediate 102.

Step S2 further includes the following steps:

S21: Flip the hair extension fixing portion 10, so that the hair extension fixing portion 10 changes from a horizontal posture to a vertical posture.

A height is preset for the first lifting apparatus 321, and the hair extension fixing portion 10 is guided to the first lifting apparatus 321, so that the hair extension fixing portion 10 has space for flipping. The hair extension fixing portion 10 is guided to the inclined portion 3212 of the hair extension fixing portion 10. The hair extension fixing portion 10 is guided by the inclined portion 3212 to have a flipping tendency. Further, the hair extension fixing portion 10 is guided to the first flipping element 3221. The first flipping element 3221 flips the hair extension fixing portion 10 into a vertical state.

S22: The first folding element 3222 applies force to the fixing portion at a middle position between the two first stitching threads of the hair extension fixing portion, so that the fixing portion is bent at the middle position between the two first stitching threads.

The first folding element 3222 is disposed between the first flipping element 3221 and the first pressing apparatus 331. The hair extension fixing portion 10 is guided to move to the first folding element 3222. The first folding element 3222 comes into contact with the hair extension fixing portion 10. Specifically, the first folding element 3222 is brought into contact with the hair extension fixing portion 10. A part of the hair extension fixing portion 10 that comes into contact with the first folding element 3222 moves away from the first side 391. In this way, the two first stitching threads 171 of the hair extension fixing portion 10 move toward each other. That is, the hair extension fixing portion 10 has a folding tendency.

S23: Fold the hair extension fixing portion 10 to form the bent portion.

The hair extension fixing portion 10 with a folding tendency is guided to the first fixing apparatus 33. The first fixing apparatus 33 further presses the hair extension fixing portion 10 with the folding tendency, to fold the hair extension fixing portion 10.

Step S21 further includes the following steps:

S211: Pull the hair extension fixing portion 10 of the initial hair extension A to the first lifting apparatus 321, so that the hair extension fixing portion of the initial hair extension A in a horizontal posture has space for flipping.

S212: Pull the hair extension fixing portion 10 of the initial hair extension to the first folding portion 322.

S213: Flip the hair extension fixing portion 10 of the initial hair extension to a vertical posture.

S214: Fold the hair extension fixing portion of the initial hair extension, so that the second hair strand layer 12 and the connecting hair strand layer 11 are stacked.

Step 214 further includes the following steps:

S2141: Push the hair extension fixing portion 10 of the initial hair extension A, so that the hair extension fixing portion 10 of the initial hair extension A has a folding tendency.

S2142: Press the hair extension fixing portion 10 of the initial hair extension A with the folding tendency, so that the hair extension fixing portion 10 of the initial hair extension A is folded.

Step S4 further includes the following steps:

S41: Pull the fixing portion intermediate 102 to a lifting portion 341, so that the fixing portion intermediate 102 is unfolded and lifted to a position, to form a positional height difference.

S42: Pull the fixing portion intermediate 102 to a second folding apparatus 351, so that the fixing portion intermediate 102 is folded for the second time and then flattened.

In another preferred embodiment of this application, step S4 further includes the following steps:

S41a: Pull the fixing portion intermediate 102 to a second lifting apparatus, so that the fixing portion intermediate 102 is unfolded and lifted to a preset height, where the additional thread 174 is placed on a surface of the fixing portion intermediate 102.

S42a: Pull the first fixing portion intermediate 102 to a second folding apparatus 351, so that the fixing portion intermediate 102 is folded and then flattened, where the additional thread 174 is wrapped inside the folded fixing portion intermediate 102.

Step S3 further includes the following steps:

S31: Guide the first bent portion 15 to a first stitching apparatus 332.

S32: A stitching needle passes through the second hair strand layer 12 and the connecting hair strand layer 11, to fix the second hair strand layer 12 and the connecting hair strand layer 11 with a stitching thread.

It is worth mentioning that before step S1, the method further includes step Sa: Remove hair cuticles. Removing the hair cuticles is removing cuticles on surfaces of hair strands, to reduce a risk of hair tangling. Cuticles of individual hair strands are in the same orientation. When the hair extension fixing portion is folded multiple times, the cuticles may be in opposite orientations. In particular, inconsistent orientations of cuticles on the second hair strand layer and the connecting hair strand layer can cause partial tangling of hair strands of an overlapped portion, which affects user experience of the product. Therefore, the entire hair strands can be subjected to cuticle removal, or partial cuticle removal can be performed on the root portions of the hair strands, to resolve the problem of partial tangling. Removing the hair cuticles, in this application, refers to disabling a function of the hair cuticles to reduce hair tangling. Further, destruction of structures of the hair cuticles and a reduction in the number of hair cuticles also fall within the scope of "removing the hair cuticles" in this application.

Specifically, the cuticle structure is destroyed and removed through oxidation. In a preferred embodiment of this application, sodium hypochlorite (NaClO) is hydrolyzed in water to form hypochlorous acid (HClO) and sodium chloride (NaCl). Due to a strong oxidizing property, hypochlorous acid releases oxidizing groups under acidic conditions to destroy the cuticle structure. In addition, sulfuric acid ($H_2SO_4$) is added to adjust a pH value of a solution, to increase a concentration of hypochlorous acid, thereby accelerating an oxidation process and further destroying and removing the cuticle structure. A result of oxidation is that cystine in the hair cuticles is oxidized into cysteine, accompanied by hydrolysis of peptide chains, and the cuticles are stripped off. Stripping of the hair cuticles also helps to enhance a bleaching effect of the hair strands.

In another preferred embodiment of this application, hair cuticles at roots of the hair strands are removed. Preferably, hair cuticles within a length range of 1-5 inches at roots of the hair strands are removed. In another preferred embodiment of this application, first, the hair cuticles within the length range of 1-5 inches at the roots of the hair strands are removed, and then a function of the hair cuticles in main bodies of the hair strands is destroyed, but structures of the hair cuticles in the main bodies of the hair strands are retained, to reduce a degree of damage to hair quality of the hair extension body.

When a comb is used to comb the hair extension in this application, the comb combs the hair extension body 20 in this application. At start of combing, the comb moves from the side, closer to the hair extension fixing portion 10, of the hair extension body to an end of the hair extension body 20. During the movement process, if some hair strands 21 of the hair extension body 20 are in a tangled state, the comb applies force to some hair strands in the tangled state to separate the hair strands 21 in the tangled state. The hair strands 21 in the tangled state are under impact of the force, and a direction of the applied force is a direction of leaving the hair extension fixing portion 10. In addition, the hair strands 21 in the tangled state applies force on the hair extension fixing portion 10. Specifically, the hair strands 21 in the tangled state are under impact of the force applied by the comb, and the hair strands 21 in the tangled state apply force to the hair extension fixing portion 10. The hair strands 21 in the tangled state apply force to the first stitching thread 171 located on the connecting hair strand layer 11 to detach from the first stitching thread 171 located on the connecting hair strand layer 11 and move toward the hair extension body 20. The first stitching thread 171 located on the connecting hair strand layer 11 prevents the hair strands 21 in the tangled state from leaving the first stitching thread 171 located on the connecting hair strand layer 11. Further, the hair strands 21 in the tangled state further applies force to the second bent portion 16. Specifically, the hair strands 21 in the tangled state further applies force to the second stitching thread 172. The second stitching thread 172 applies reaction force to the hair strands 21 in the tangled state to prevent the hair strands 21 in the tangled state from moving toward the hair extension body 20. In addition, the second stitching thread 172 transfers the force from the hair strands 21 in the tangled state to the second hair strand layer 12, the third hair strand layer 13, and the fourth hair strand layer 14, to reduce impact of the hair strands 21 in the tangled state on the second stitching thread 172. It is worth mentioning that the hair strands 21 in the tangled state are located at the hair extension body 20, and the hair extension body 20 is connected to the connecting hair strand layer 11. The second hair strand layer 12 is in contact with the connecting hair strand layer 11. When moving away from the hair extension fixing portion 11, the hair strands 21 in the tangled state drive the connecting layer hair strands 111 in the connecting hair strand layer 11 that are connected to the hair strands 21 in the tangled state to move toward the hair extension body 20. Under the impact of frictional force, hair strands of the second hair strand layer 12 that are in contact with the connecting layer hair strands 111 prevent the connecting layer hair strands 111 in the connecting hair strand layer 11 that are connected to the hair strands 21 in the tangled state from moving toward the hair extension body 20. Further, the hair strands 21 in the tangled state applies force to the second bent portion 16 through the connecting hair strand layer 11. Specifically, the hair strands 21 in the tangled state applies force to the second outer bent portion 161, so that the second outer bent portion 161 applies force to a portion of the second stitching thread 172 that fixes the fourth hair strand layer 14, thereby enabling the hair strands of the fourth hair strand layer 14 that are connected to the hair strands 21 in the tangled state to move toward the second bent portion 161. However, the second stitching thread 172 fixing the fourth hair strand layer 14 prevents the hair strands of the fourth hair strand layer that are connected to the hair strands in the tangled state from moving toward the second outer bent portion 161. In addition, the third hair strand layer 13 is in contact with the fourth hair strand layer 14, and the third layer hair strands 131 of the third hair strand layer 13 prevent the hair strands of the fourth hair strand layer that are connected to the hair strands in the tangled state from moving toward the second outer bent portion 161. In addition, the hair strands 141 of the fourth hair strand layer that are connected to the hair strands 21 in the tangled state apply force to the third stitching thread 173, so that the hair strands of the fourth hair strand layer that are connected to the hair strands in the tangled state move toward the second bent portion 16. In addition, the third stitching thread 173 prevents the hair strands 14 of the fourth hair strand layer that are connected to the hair strands 21 in the tangled state from moving toward the second bent portion 16. In addition, the third stitching thread 173 fixes the fourth hair strand layer 14 and the third hair strand layer 13. In other words, the third stitching thread 173 transfers, to the third hair strand layer 13, a portion of the force applied to the third stitching thread 173 by the hair strands 14 of the fourth hair strand layer that are connected to the hair strands 21 in the tangled state. The force applied to the first bent portion 15 by the hair strands 14 of the fourth hair strand layer that are connected to the hair strands 21 in the tangled state is weakened. The hair strands 14 of the fourth hair strand layer that are connected to the hair strands 21 in the tangled state apply force to the third hair strand layer through the first bent portion 15. Because the third hair strand layer 13 is fixed by the third stitching thread 173, the force applied to the third hair strand layer through the first bent portion 15 by the hair strands 14 of the fourth hair strand layer that are connected to the hair strands 21 in the tangled state is weakened. Further, the hair strands 131 of the third hair strand layer that are connected to the hair strands 21 in the tangled state apply force to the second hair strand layer 12 through the second bent portion 162. Because the second stitching thread 172 fixes the second hair strand layer 12, the force applied to the second hair strand layer 12 through the second inner bent portion 162 by the hair strands 131 of the third hair strand layer that are connected to the hair strands 21 in the tangled state is weakened. Finally, the hair strands 121 of the second hair strand layer that are connected to the hair strands 21 in the tangled state apply force to the first stitching thread 171, to move away from the hair extension body 20. The first stitching thread 171 prevents the hair strands 121 of the second hair strand layer that are connected to the hair strands 21 in the tangled state from applying force to the first stitching thread 171, to prevent the hair strands 121 of the second hair strand layer that are connected to the hair strands 21 in the tangled state from falling off.

Those skilled in the art shall understand that the embodiments of the present invention shown in the accompanying drawings and described above are merely exemplary and not restrictive.

In summary, the objectives of the present invention have been completely and effectively achieved. For the purpose of describing the functions and structural principles of the present invention, the embodiments have been shown and described and may be modified without departing from these principles. Therefore, the present invention encompasses all modifications included within the spirit and scope of the following claims.

What is claimed is:

1. A hair extension, comprising:

a hair extension fixing portion; and a hair extension body, wherein the hair extension body is connected to the hair extension fixing portion, the hair extension fixing portion further comprises a connecting hair strand layer, a second hair strand layer, a third hair strand layer, a fourth hair strand layer, two first stitching threads, a second stitching thread, and a third stitching thread, the connecting hair strand layer is connected to the hair extension body, the connecting hair strand layer, the second hair strand layer, the third hair strand layer, and the fourth hair strand layer form a stacked structure, the second hair strand layer is located between the connecting hair strand layer and the third hair strand layer, the third hair strand layer is located between the second hair strand layer and the fourth hair strand layer, the two first stitching threads are respectively used to stitch the connecting hair strand layer and the second hair strand layer, the two first stitching threads are disposed close to the hair extension body, the second stitching thread is used to stitch the third hair strand layer and the fourth hair strand layer, and the third stitching thread is used to stitch the connecting hair strand layer, the second hair strand layer, the third hair strand layer, and the fourth hair strand layer;

wherein the hair extension fixing portion further comprises a first bent portion, the first bent portion is connected to the third hair strand layer and the fourth hair strand layer, and the first bent portion is close to the hair extension body.

2. The hair extension according to claim 1, wherein the hair extension fixing portion further comprises a second bent portion, the second bent portion is disposed at an end farther away from the hair extension body, the second bent portion further comprises a second inner bent portion and a second outer bent portion, the second outer bent portion is located on an outer side of the second inner bent portion, the second inner bent portion is respectively connected to the second hair strand layer and the third hair strand layer, and the second outer bent portion is respectively connected to the connecting hair strand layer and the fourth hair strand layer.

3. A hair extension, comprising:

a hair extension body, and a hair extension fixing portion, wherein the hair extension body is connected to the hair extension fixing portion, wherein the hair extension fixing portion further comprises a connecting hair strand layer, a second hair strand layer, a second stitching thread, and two first stitching threads, the connecting hair strand layer is connected to the hair extension body, the connecting hair strand layer and the second hair strand layer form a stacked structure, the two first stitching threads are respectively stitched to the connecting hair strand layer and the second hair strand layer, the second stitching thread is stitched to the connecting hair strand layer and the second hair strand layer;

wherein the connecting hair strand layer and the second hair strand layer are folded to the hair extension body to define a third hair strand layer and a fourth hair strand layer, the third hair strand layer is connected with the second hair strand layer, the fourth hair strand is connected with the connecting hair strand layer, wherein the third strand layer is located between the second hair strand layer and the fourth hair strand layer, the second hair strand is located between the connecting hair strand layer and the third hair strand layer, wherein the hair extension fixing portion further comprises a third stitching thread, the third stitching thread is stitched to the connecting hair strand layer, the second hair strand layer, the third hair strand layer, and the fourth hair strand layer.

4. The hair extension according to claim 3, wherein the third stitching thread is located between the second stitching thread and the two first stitching thread.

5. The hair extension according to claim 4, wherein the hair extension fixing portion further comprises a first bent portion, the first bent portion is connected to the third hair strand layer and the fourth hair strand layer, and the first bent portion is close to the hair extension body.

6. The hair extension according to claim 4, wherein the hair extension fixing portion further comprises a first bent portion, the first bent portion is connected to the third hair strand layer and the fourth hair strand layer, and the first bent portion is close to the hair extension body, wherein the hair extension fixing portion further comprises a second bent portion, the second bent portion is disposed at an end farther away from the hair extension body.

7. The hair extension according to claim 6, wherein the second stitching thread is located near the second bent portion.

8. The hair extension according to claim 7, wherein the hair extension fixing portion further comprises an additional thread, the additional thread is disposed between the second hair strand layer and the connecting hair strand layer.

9. The hair extension according to claim 3, wherein the hair extension fixing portion further comprises:

a first bent portion, the first bent portion is connected to the third hair strand layer and the fourth hair strand layer, and the first bent portion is close to the hair extension body; and a second bent portion, the second bent portion is disposed at an end farther away from the hair extension body.

10. The hair extension according to claim 9, wherein the second stitching thread is located between the first bent portion and the second bent portion.

11. The hair extension according to claim 9, wherein the second stitching thread is located between the third stitching thread and the two first stitching threads.

12. The hair extension according to claim 9, wherein the hair extension fixing portion further comprises and additional thread, the additional thread is disposed between the third hair strand layer and the four hair strand layer.

* * * * *